United States Patent [19]

Nolin

[11] 3,933,016

[45] Jan. 20, 1976

[54] DOOR LOCK MECHANISM

[75] Inventor: Roger J. Nolin, Monterey Park, Calif.

[73] Assignee: TRE Corporation, Beverly Hills, Calif.

[22] Filed: Oct. 29, 1974

[21] Appl. No.: 518,277

[52] U.S. Cl. ..... 70/149; 70/388; 292/165

[51] Int. Cl.[2] ..... E05C 1/12; E05B 17/00; E05B 55/00

[58] Field of Search ..... 70/149, 156, 379 R; 292/165, 167, 336.3

[56] References Cited

UNITED STATES PATENTS

| | | | |
|---|---|---|---|
| 2,724,258 | 11/1955 | McConnell | 70/149 |
| 2,916,903 | 12/1959 | Squire | 70/149 |
| 3,430,469 | 3/1969 | Baxter et al. | 70/388 |
| 3,808,849 | 5/1974 | Alexander | 70/149 |

*Primary Examiner*—Paul R. Gilliam
*Assistant Examiner*—Victor N. Sakran
*Attorney, Agent, or Firm*—Blakely, Sokoloff, Taylor & Zafman

[57] ABSTRACT

A handle set door lock comprised of an outer assembly with a handle, a thumb piece actuator, a key operated cylinder, a latch bolt and operating mechanism, and a selective control member is disclosed. When the selective control member is in a first position, depression of the thumb piece actuator engages the operating mechanism causing the retraction of the latch bolt. When the selective control member is in a second position, the thumb piece actuator is disengaged from the operating mechanism permitting depression of the thumb piece actuator but without causing retraction of the latch bolt. The latch bolt can always be retracted by the conventional key operated cylinder located on the outer assembly when the selective control member located on the inner knob is in either the first or second position. In addition, a unique gear driven key operated assembly provides improved mechanical advantages, and combined with the above described latch bolt retraction means, provide a simple and more compact mechanism not requiring extra openings in the door for mechanism clearance.

26 Claims, 13 Drawing Figures

DOOR LOCK MECHANISM

BACKGROUND OF THE INVENTION

1. Field of the Invention

The present invention relates to the field of door locks and, more particularly, to handle door lock types.

2. Prior Art

In the past, external door locks utilizing a thumb piece actuator and key mechanism were normally locked by blocking operation of the external thumb piece actuator. When one attempted to force open a door with a lock which was in the locked position, all that was needed to damage the lock was to press down the thumb piece actuator with more force than the blocking mechanism was constructed to withstand. This would cause the lock mechanism, which is generally activated by the thumb piece actuator, to bend or break, thereby permitting illegal entry, or to become inoperative resulting in the necessity of complete removal of the lock mechanism and replacement of the bent or broken parts. In addition, especially during the construction phase of buildings having multiple lock installations, the thumb piece actuator has become a prime subject of vandalism. For example, a vandal would attempt to enter into the locked area by striking the thumb piece actuator. In most instances, the thumb piece actuator will merely bend or break and entry will not be achieved. However, the thumb piece actuator, as well as other parts, may have to be completely replaced. Consequently, it has long been the practice in the prior art to use expensive and bulky thumb piece actuators and blocking mechanisms in an attempt to eliminate, or at least substantially reduce the vandalism encountered in forceable entry attempts. Of course, this is expensive and does not completely prevent vandalism and illegal entry inasmuch as a vandal is likely to strike the thumb piece actuator with a heavy blunt instrument. If such was the case, the lock mechanism itself may be severly damaged requiring the complete door lock to be removed and repaired or replaced. The necessity of complete removal accentuates the problems associated with the prior art thumb piece actuators which are immovable when the lock mechanism is in the locked position.

Another aspect of prior art external door locks is that they require at least two holes to be drilled in the door so as to communicate with the outside escutcheon; one hole for the door knob and a second hole for the lock cylinder assembly. The second hole is necessary inasmuch as the prior art lock cylinder assemblies are too large to fit into the outside excutcheon. The prior art lock cylinder assemblies consist of a complicated series of metal bars and levers which are activated and set into motion when the lock cylinder is rotated. These bars and levers are expensive, subject to malfunction, and take up much of the space in the escutcheon housing. Because of the exactness required for placement of the holes in the door, expensive equipment is also required to drill the required holes for the lock assemblies. In addition, there is considerable time required for determining the exact location of the holes, and therefore, any extra holes can add significantly to the cost and complexity of installation. This problem is especially acute when one considers that an improperly drilled hole can cause the entire lock mechanism to be rendered inoperative. Further, expensive repairs may be required to patch an undesired hole in the door before a second attempt of installation can be made. It is thus apparent that any prior art door lock which requires extra holes to be drilled in the door for the lock cylinder mechanism suffers severe shortcomings.

The present invention encompasses novel improvements for a door lock which offers desirable characteristics heretofore lacking in the prior art locks.

BRIEF SUMMARY OF THE INVENTION

The present invention relates to a door lock comprised of a lock mechanism which has a reciprocating latch bolt disposed in the mechanism. The latch bolt is adapted so as to be engaged by a latch driving assembly means. When the latch driving means is activated by an actuating member, for example, by a thumb piece actuator, the latch driving means effects movement of the latch bolt between retracted and extended positions. The lock mechanism also has a selective control member disposed in it. When the selective control member is in a second position, the thumb piece actuator is disengaged and may be fully depressed while the latch bolt remains in the extended position without causing the latch bolt to move into the retracted position. When the selective control member is in a first position, the thumb piece actuator engages the latch driving means so as to cause the latch bolt to move into the retracted or unlocked position. The latch bolt can also be activated by a key and associated lock cylinder assembly irrespective of whether the selective control member is in the first or the second position. Another important aspect of the present invention is that the lock cylinder assembly activates a unique gear driven system which causes the movement of the latch bolt. Because the gear driven system does not protrude inwardly beyond the escutcheon on which the invented lock mechanism is mounted, there is no requirement for a hole to be drilled in the door for the lock cylinder assembly. Using the door lock mechanism of the present invention, a vandal proof and jam retardant lock which may be easily installed is achieved. It is, therefore, an object of the present invention to provide a door lock which enables full depression of the thumb piece actuator while the latch bolt is in the extended position without causing the latch bolt to retract.

Another object of the present invention is to allow the latch bolt to be retracted by the use of a key means or a thumb piece actuator when the lock mechanism is in the unlocked position.

A third object of the present invention is to provide a door lock which can be easily installed and which does not require the drilling of an additional hole for the lock cylinder assembly.

Finally, another object of the present invention is to provide a gear drive means which is activated by a key and associated lock cylinder assembly, and which causes the latch bolt to reciprocate between extended and retracted positions.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DETAILED DESCRIPTION OF THE INVENTION

The present invention is a door lock which prevents illegal entry by forcing or the breaking of the outside actuating member, for example, a thumb piece actuator, in the event that the actuating member is forceably depressed when the lock assembly is in the locked position. The present invention is intended for use primarily in outer doors of such installations as apartment houses, homes, motels, etc. where a lock assembly would be a likely target of vandalism and forced entries, or where highly demanding treatment and abuse of the lock assembly may have a tendency to cause the lock mechanism to break, bend, or jam. Broadly, the invented door lock comprises a lock mechanism, a latch bolt, a latch driving means, an outside actuating member, and a selective control member. The selective control member and the latch bolt are coupled so as to allow the latch bolt to be selectively activated by the outside actuating member. When the selective control member is in a first position, the latch bolt can be retracted via the latch driving means by depressing the outside actuating member. The latch driving means is disposed in the lock mechanism so as to effect movement of the latch bolt from extended to retracted positions. When the selective control member is in a second position, the outside actuating member may still be fully depressed but the latch bolt does not retract; rather it remains in the extended position. Thus, illegal entry or damage to the lock mechanism is substantially prevented when the selective control member is in the second position inasmuch as depression of the thumb piece actuator does not activate or otherwise set into motion the latch bolt. Another aspect of the present invention is that the latch bolt may also be activated in the normal fashion by a key and associated lock cylinder assembly which causes the latch bolt to reciprocate between the retracted and extended positions by a novel driven system. Thus, the key and associated lock cylinder assembly cause the latch bolt to reciprocate irrespective of whether the selective control member is in the first or second position.

The lock cylinder assembly of the present invention can be fully disposed in a typical escutcheon without any inner protrusion, thereby allowing the escutcheon and lock mechanism to be mounted on a door without the need for a separate hole which is usually required to be drilled for receiving a protruding lock cylinder assembly. This feature is made possible by a unique gear driven system. The gear driven system is compact, jam retardent and enables the action of the lock cylinder assembly to be effectively and efficiently transmitted to the latch bolt. Thus, the lock cylinder of the present invention may be disposed on the escutcheon without the need for increasing the dimensions of the escutcheon or drilling an additional hole in the door in order to receive the lock cylinder.

Figure 1:
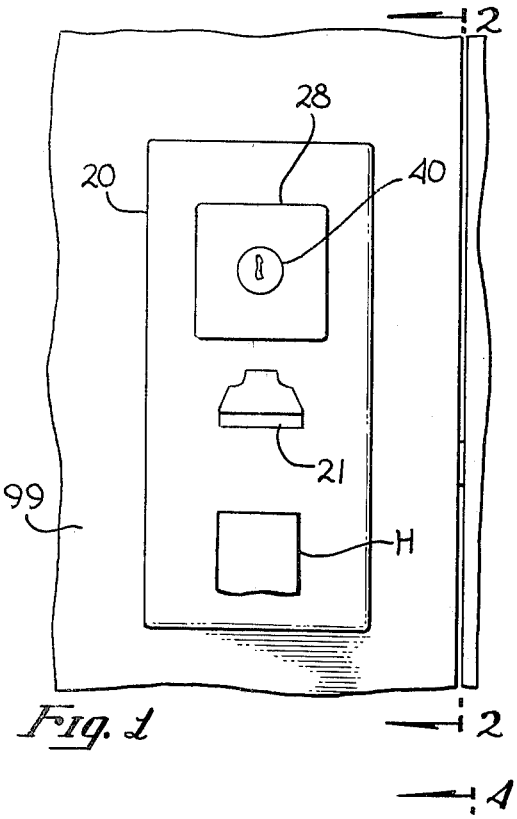
FIG. 1 is a front view of an outside escutcheon containing the invented door lock mechanism mounted on a door frame.
Figure 3:
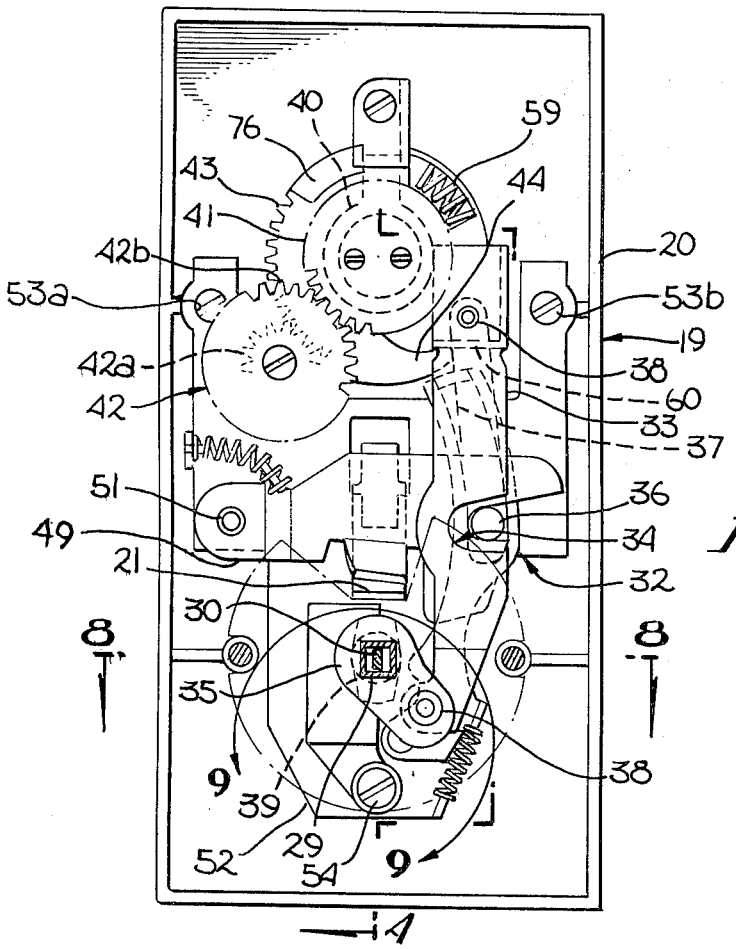
FIG. 3 is a cross-sectional view of the escutcheon and lock mechanism of FIG. 2 taken through section lines 3—3 showing the invented mechanism in the unlocked position mounted on the inside of the escutcheon.

Referring first to FIGS. 1 and 3, the escutcheon 20 houses the inner working of the entire invented lock mechanism. In the presently preferred embodiment, the invented lock mechanism is mounted on the inside surface of the escutcheon 20. However, it is within the scope of the present invention to use other mounting means such as plates and the like for mounting the lock mechanism to the door. In the presently preferred embodiment, the lock mechanism 19 is attached to the escutcheon 20 by means of a lock assembly bracket 52 and screw means **53*a*, 53*b* and 54 which are received in threaded holes, as shown in FIG. 3. In the upper center of the escutcheon 20 is an outer protrusion 28 which contains the lock cylinder assembly 40 within its perimeter. Of course, the outer protrusion 28 may be of various shapes and sizes as is known in the art. The actuating member is comprised of a thumb piece actuator 21 and a grooved pin movement arm 49. The thumb piece actuator 21 is generally disposed beneath the lock cylinder assembly 40, however, in other embodiments of the present invention, the thumb piece actuator 21 may be disposed above or to the side of lock cylinder assembly 40** as desired. There may also be various types of handle means H disposed at various locations on the door to provide the user with an easy gripping means for opening and closing the door.

Figure 2:
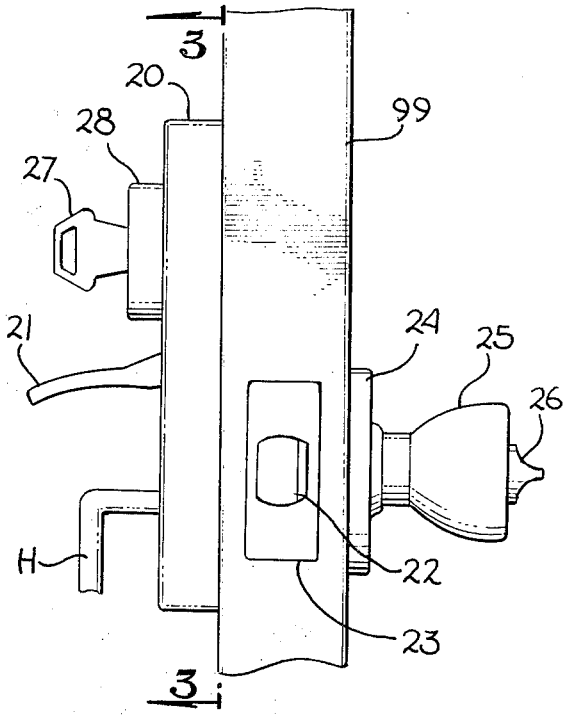
FIG. 2 is a side view of the door frame showing the escutcheon and lock mechanism of FIG. 1 on one side of the door frame and an inside door knob on the other side.

In FIG. 2, a cross-sectional view of the door 99 is shown so as to point out the relative positions of the various elements in the presently preferred embodiment of the present invention. A door knob assembly means 25 is disposed on the inner side of the door 99, and the escutcheon 20 is disposed on the outer side of the door 99. An inside rosette 24 aids in aligning the door knob assembly 25 to the door 99, and in covering the hole on the inside of the door.

Figure 4:
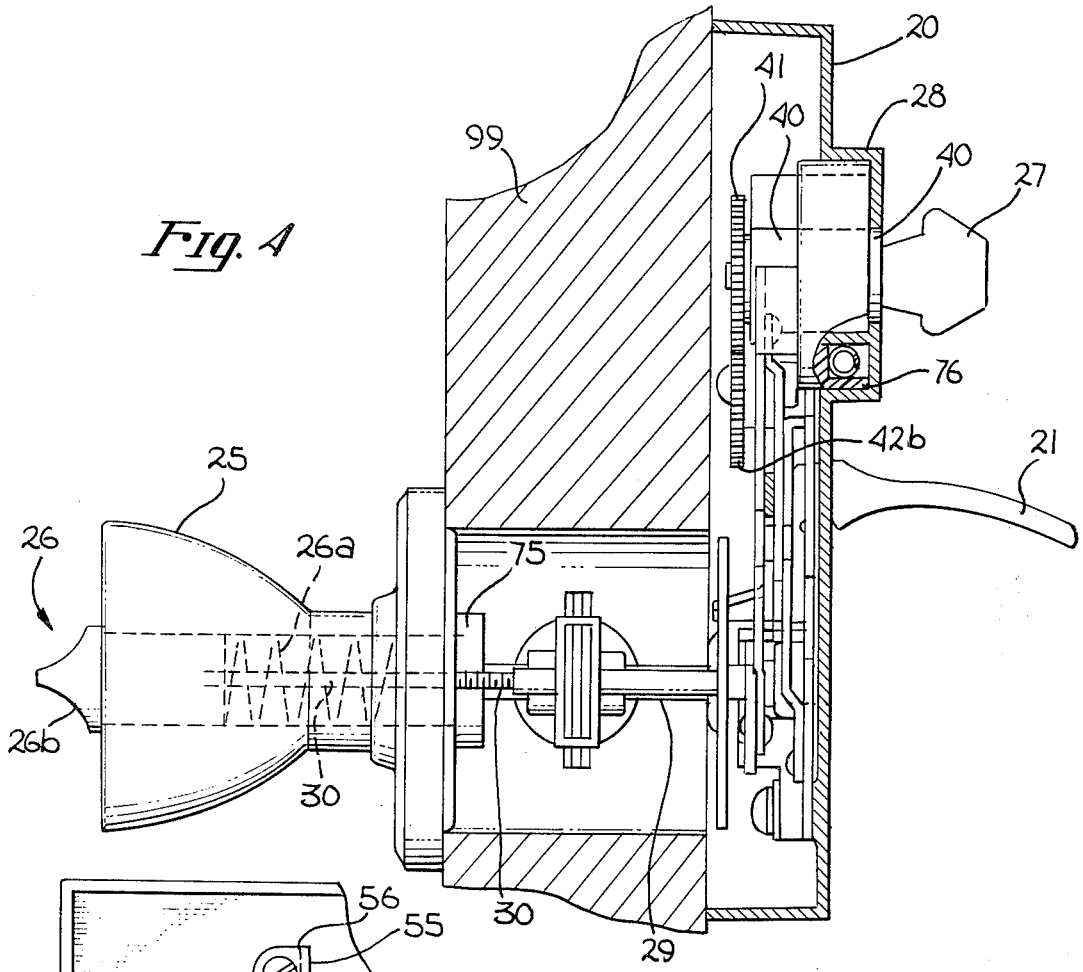
FIG. 4 is a cross-sectional view of the escutcheon and lock mechanism of FIG. 3 taken through section lines 4—4 showing the invented gear drive means.
Figure 8:
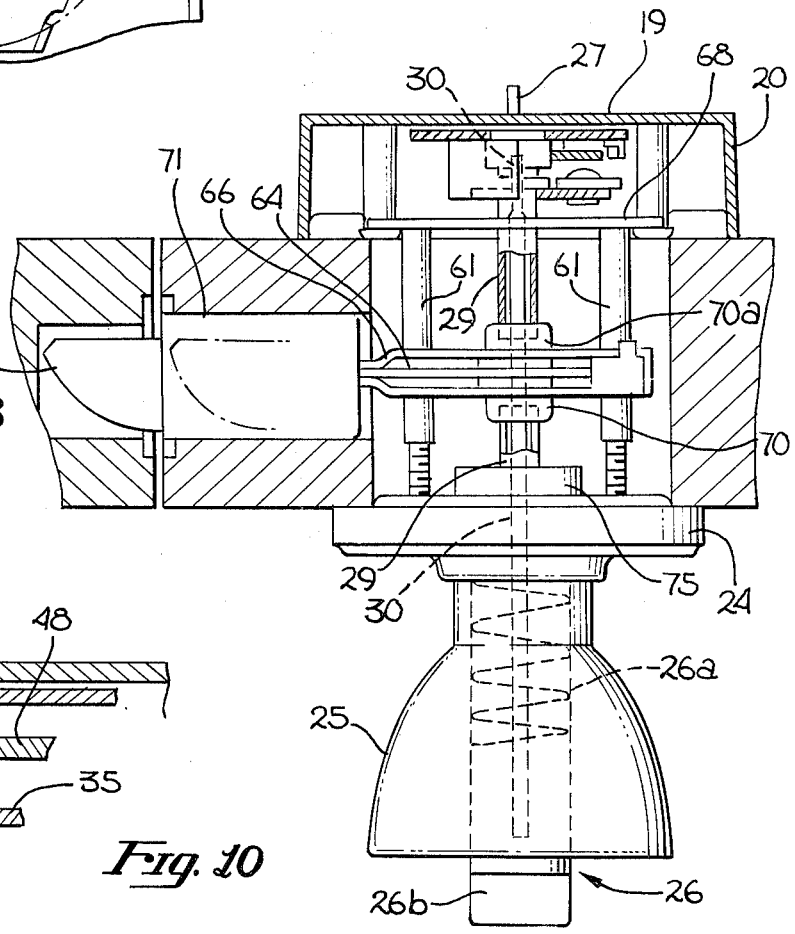
FIG. 8 is a cross-sectional view of FIG. 3 taken through section lines 8—8 showing the action of the latch bolt, a control button and an inside door knob.

Referring to FIGS. 4 and 8, a control member 26 is shown as axially disposed in the inside door knob assembly 25. In the preferred embodiment the selective control member takes the form of a control button member 26, which may be rotated from a first position to a second position although other selective control means, are within the scope of the invention. The control button member 26 is disposed through the door 99 into the lock mechanism 19 and is comprised of a spring 26*a* and a rotatable member 26*b*. A solid spindle 30 is disposed in the rotatable member 26*b* and rotates when member 26*b* is rotated. While the control button member 26 is illustrated to be actuated by rotation, it can be actuated by a push button action, if desired. When the control button member 26 is in the first position, depressing thumb piece actuator 21 causes the latch bolt 22, mounted in the latch face 23, to retract and to move into an unlocked position enabling one to open the door. When the control button member 26 is in the second position, the latch bolt 22 can only be retracted from the outside by rotating key 27 in the associated lock cylinder assembly 40.

Referring now again to FIG. 3, there is shown the lock mechanism 19 disposed within and mounted on the escutcheon 20. FIG. 3 shows the lock mechanism 19 in the "unlocked position". By the unlocked position it is meant that the control button member 26 shown in FIGS. 4 and 8, is in the first position. This allows the thumb piece actuator 21, when depressed, to cause the latch bolt 22 to retract and move into an retracted position which permits one to open the door. As will be pointed out with specificity hereinafter, when the lock mechanism is in the unlocked position, the latch bolt 22 may also be retracted and moved to the unlocked position by rotation of the key 27 in the associated lock cylinder assembly 40. It should be noted that when the lock mechanism 19 is in the unlocked position, the solid spindle 30 is in an upright or vertical position.

Figure 5:
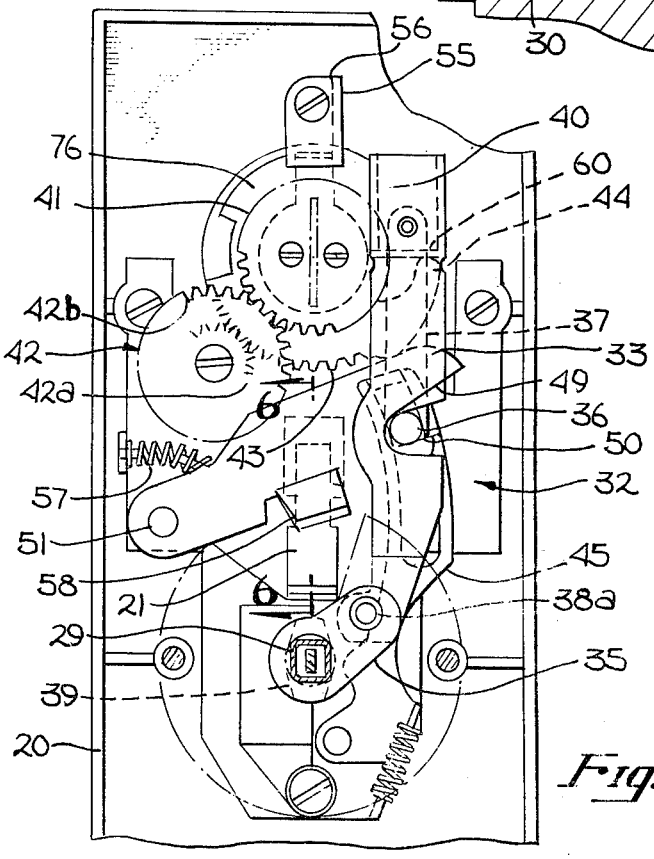
FIG. 5 is a further cross-sectional view of the escutcheon and lock mechanism of FIG. 3 showing the mechanism in the unlocked position with the key rotated 180°.

Referring again to FIG. 3, a latch driving assembly means 32 for engaging the latch bolt 22 is shown as comprising (i) an arm 33, (ii) a notch 34 in the arm 33, (iii) a latch engaging cam 35 disposed at one end of the arm, (iv) a pin 36 disposed near the end of the pin arm 37, and (v) an arm ledge 60 disposed near the opposite end of the arm 33 with respect to the cam 35. The latch driving means 32 is cooperatively coupled in the lock mechanism 19 between the segment gear arm 44, which is disposed on the segment gear 43, and the hollow spindle 29. In the presently preferred embodiment, the segment gear 43 and segment gear arm 44 are disposed near the top of the escutcheon 20, and the cam 35 and hollow spindle 29 are disposed near the bottom of the escutcheon. The arm ledge 60 is disposed on or near the segment gear arm 44 such that when the segment gear arm 44 moves in the upward position, the gear arm 44 engages the arm ledge 60 and thus, the latch driving assembly 32 also travels upward as is best shown in FIG. 5. The hollow spindle 29 has a square cross section in the presently preferred embodiment which is disposed into a square cut area of substantially the same size and shape which has been disposed through latch engaging cam 35. As the latch driving means 32 travels upward, the cam 35 (disposed on swivel rivet 38*a*) and the hollow spindle 29, are caused to partially revolve as clearly shown in FIG. 5. Because the cam 35 is coupled to the latch bolt 22 via the hollow spindle 29 and a latch bolt activating apparatus, shown as latch bolt driving bar 64 in FIG. 8, by revolving the hollow spindle 29, the latch bolt driving bar causes the latch bolt 22 to move into the retracted position. Hence, one way to cause the latch bolt 22 to move into the retracted position, as more fully described hereinafter, is to move the latch driving means 32 upward by rotation of segment gear 43 and segment gear arm 44.

Figure 7:
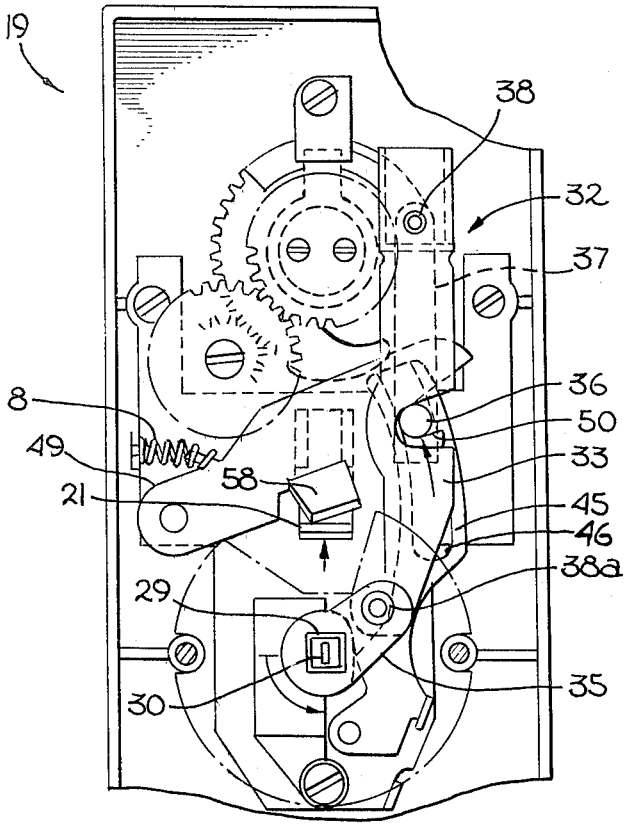
FIG. 7 is a partial cross-sectional view of the escutcheon and lock mechanism of FIG. 3 showing the mechanism in the unlocked position and with the thumb actuator depressed.
Figure 11:
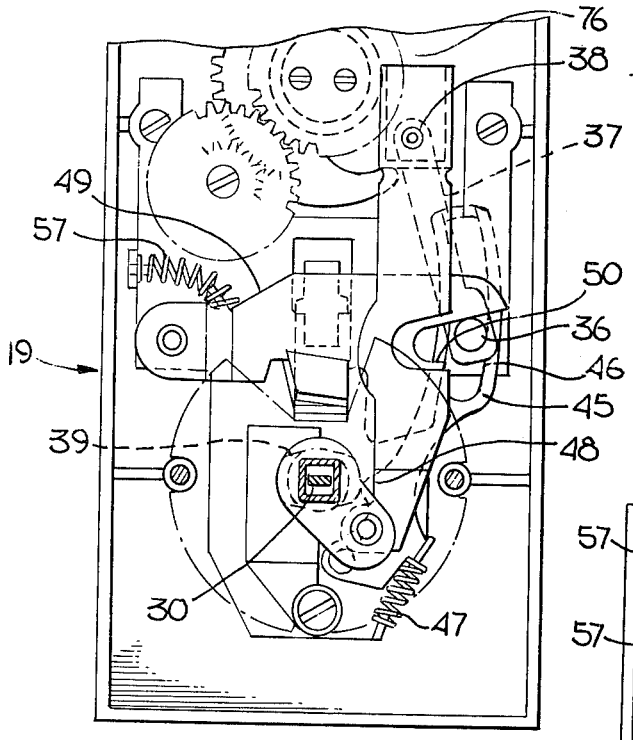
FIG. 11 is a further partial cross-sectional view of the escutcheon and lock apparatus shown in FIG. 2 showing the mechanism in the locked position and the pin track disengaged from the latch driving assembly.

Another way to retract the latch bolt 22 is to depress the thumb piece actuator 21, as shown in FIG. 7, which communicates with the pin 36 on the pin arm 37 by means of the grooved pin movement arm 49. In the presently preferred embodiment, the pin arm 37 is disposed under the arm 33 near the top of the latch driving means 32 by means of a swivel rivet 38 and is moveable from a position near the center of the mechanism 19 to an outward position, as shown in FIG. 11. As the arm 49 is moved upward by depressing the thumb piece actuator 21, the pin 36 is engaged and forces the pin arm 37 upwardly. Inasmuch as the pin arm 37 is coupled to the latch driving means 32 by means of swivel rivet 38, the latch driving means is also driven into an upward position. As the latch driving means is driven upward, the cam 35 is again rotated which causes the hollow spindle 29 to rotate. The rotation of the hollow spindle 29 causes the latch bolt 22 to retract (shown in FIG. 8) as previously discussed.

Referring now to FIG. 4, a cross-sectional view of the lock mechanism 19 is shown. The control button member 26, made up of spring 26*a* and rotatable member 26*b*, is shown as axially disposed through the door knob 25 and as coupled to the solid spindle 30. When the control button member 26 is rotated by depressing the rotatable member 26*b* into the door knob 25 and rotating it to a second position, the solid spindle 30 is caused to rotate in the same direction as the spring loaded member. The solid spindle 30 is also engaged by the solid spindle cam 39 shown in FIGS. 5 and 9, and as the solid spindle rotates, so does the cam 39. The solid spindle 30 is disposed axially through hollow spindle 29, such that hollow spindle 29 does not rotate upon rotation of the solid spindle 30 since only the solid spindle is coupled to the rotatable member 26b. Also in FIG. 4 is the lock cylinder gear 41, referred to as the first gear, shown as disposed vertically and axially on lock cylinder assembly 40. Rotation of the key 27 causes the lock cylinder gear 41 to rotate and to transmit the rotation to a transmitter gear means 42, also referred to as the second gear. The transmitter gear means 42 is comprised of two integral gears, 42*a* and 42*b*. Gear 42*b* engages the lock cylinder gear 41 and gear 42*a* engages the segment gear 43, the latter gear also referred to as the third gear.

In FIG. 5, the effect of rotating the key in the lock cylinder 40 when the lock mechanism 19 is in the unlocked position is most clearly shown. Rotation of the key activates the gear driven system which causes the latch bolt 22 to move into the open position as hereinafter described. In the presently preferred embodiment, the lock cylinder assembly 40 is disposed in and mounted to the escutcheon by means of lock cylinder bracket 55 and screw 56. The housing 76 which contains integral segment gear 43 and gear arm 44, is disposed within the outer protrusion 28 as shown in FIG. 4. FIG. 5 clearly shows that transmitter gear 42*a* in the present embodiment is disposed adjacent to and under transmitter gear 42*b*. Transmitter gears 42*a* and 42*b* provide for an unexpectedly smooth extending and retracting of the latch bolt 22. As the key in the lock cylinder assembly 40 is rotated (causing the lock cylinder gear 41 to rotate), the rotation is transmitted via transmitter gears 42*a* and 42*b*, to segment gear 43. And as segment gear 43 rotates, the gear arm 44, radially disposed adjacent to gear 43 and along the periphery of housing 76, is caused to engage the arm ledge 60 of the latch driving assembly 32. In the presently preferred embodiment, segment gear 43 is axially disposed around lock cylinder assembly 40 and contains gear teeth on only about one fourth of its circumference as seen in FIGS. 3 and 5. In other embodiments, the segment gear 43 can contain teeth along more or less of the circumference depending on the rotation required. In the presently preferred embodiment, the gears 41, 42*a*, 42*b*, and 43 are made of molded nylon, but other plastics and metals may be used as castings or moldings and are within the scope of the invention.

Comparing FIG. 5 with FIG. 3, one can see in FIG. 5 that as the lock cylinder assembly 40 is rotated, the gear arm 44 has engaged the arm ledge 60 causing the entire latch driving means 32 to be driven upwardly. As the segment gear 43 rotates, it compresses segment gear spring 59 shown in FIG. 3. After the user turns the key, thereby causing the latch bolt 22 to move into the retracted position, and then releases the key, the key and latch bolt 22 automatically return to the extended position they initially occupied because of the action of the spring 59. Thus, another desirable feature of the present invention is achieved, namely automatic return of the latch bolt 22 to the extended position when the key is released.

In the presently preferred embodiment, the gear ratios of gears 41, 42*a*, 42*b*, and 43 are selected such that a rotation of the key 27 of approximately 180° causes the gear arm 44 mounted on segment gear 42 to rotate approximately 60°. Various gear ratios, as well as different physical configurations of gears are a matter of choice to one of skill in the art and should be selected based upon the mechanical advantage desired. It should be noted that in FIG. 5, as the latch driving means 32 is driven upwardly, the latch engaging cam 35 is caused to rotate about the swivel rivet 38*a*. Rotation of cam 35 causes the hollow spindle 29, which is disposed through cam 35, to rotate. Rotation of hollow spindle 29 activates the latch bolt driving bar 64 which causes the latch bolt 22 to be disposed into the retracted position, as shown in FIG. 8.

Also shown in FIG. 8 is the solid spindle 30 axially disposed in the control button member 26. One can see that the hollow spindle 29 is actually made up of two separate sections. By rotating the door knob 25 the hollow spindle 29 is also caused to rotate inasmuch as the spindle 29 is coupled to the door knob through an alignment member 75. The section of the hollow spindle 29 that is disposed to the door knob 25 is also disposed into the hollow spindle holder 70. When the door knob is rotated, the spindle holder 70 is also caused to rotate which activates the latch bolt driving bar 64. The latch bolt driving bar 64 is disposed between a first support means 65 and a second support means 66. The latch bolt driving bar 64 is also reciprocatably disposed to the latch bolt 22. As the latch bolt driving bar 64 is moved, the latch bolt 22 is caused to withdraw into cavity 71 (in the retracted position) thereby allowing the door to open.

There is also a section of the hollow spindle 29 that is disposed between lock mechanism 19, and hollow spindle holder 70*a*. As this section of the hollow spindle 29 is rotated (because of an upward movement of means 32), the same effect on the latch bolt 22 is achieved, namely, the latch bolt 22 is caused to move into the retracted position. In effect, rotation of hollow spindle 29 in holder 70*a* causes the latch bolt driving bar 64 to move the latch bolt 22 into the retracted position. The first and second support means 65 and 66, respectively, of the latch bolt driving bar 64 are supported by a suitable mounting means, e.g., by mounting screws 62 and threaded members 61. In the presently preferred embodiment, the threaded members 61 are joined to a back plate 68. The back plate 68 is mounted to the escutcheon 20 when the screws 62 are disposed through the rosette 24. Thus, the door knob 25 and the escutcheon are joined together to make up the door lock of the present invention.

Figure 6:
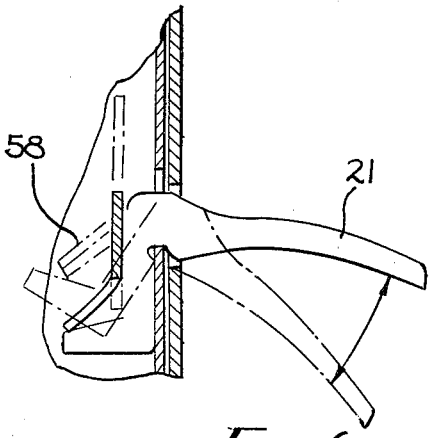
FIG. 6 is a partial cross-sectional view taken through section lines 6—6 of FIG. 5 showing the action of the thumb actuator.

In FIG. 5, pin 36 is shown as engaging the grooved pin movement arm 49 at groove 50 as the lock cylinder assembly 40 is rotated. The pin movement arm 49 is driven into an upward direction and rotates about the pin movement of rivet 51 as the pin 36 engages the arm 49. As the movement arm 49 moves upwardly, it begins to disengage the thumb piece actuator 21 from the pin movement tongue 58. However, the action of the movement arm 49 is passive and has no effect on extending or retracting the latch bolt 22. When the key 27 is rotated as shown in FIG. 5, the thumb piece actuator 21, seen clearly in FIG. 6, may travel upwardly as the pin movement tongue 58 passively travels upwardly and disengages the thumb piece actuator. Any movement of the thumb piece actuator 21, however, is also passive when the key (and therefore the gear driven system) is used to activate the latch bolt 22. However, because of tension placed on the pin movement spring 57 as the movement arm 49 is disposed upwardly, when the key is released, the spring 57 causes the movement arm 49 and the movement tongue 58 to return to their original positions.

Referring now to FIG. 7, the control button 26 is still in the first position and thus, the solid spindle 30 has not been rotated. It can be seen that the latch driving means 32 may also be actuated by the depression of the actuating member (comprised of thumb piece actuator 21 and grooved pin movement cam 49). When the thumb piece actuator 21 is depressed, it engages the pin movement tongue 58. Movement tongue 58 is mounted on the grooved pin movement arm 49. As the grooved pin movement arm 49 is forced upwardly by the depression of the thumb piece actuator 21, the pin movement groove 50 engages the pin 36 on the pin arm 37 and forces the entire latch driving means 32 upwardly. (The entire latch driving means is forced upward since the pin arm 37 is positioned to the top of the latch driving means by swivel rivet 38*a*). As the latch driving means 32 is forced upwardly, the latch engaging cam 35 is rotated about the swivel rivet 38*a*, and the hollow spindle 29, disposed through the latch engaging cam 35, is thereby rotated. Rotation of the hollow spindle 29 causes the latch bolt 22, as shown in FIG. 8, to be moved into the retracted position as previously discussed. Note that in FIG. 7 the depression of the thumb piece actuator 21 does not cause the gears 41, 42*a*, 42*b*, or 43 to be rotated. When the thumb piece actuator 21 is used to selectively activate the latch bolt 22, the lock cylinder assembly 40 becomes the passive element of the invented lock mechanism.

Figure 9:
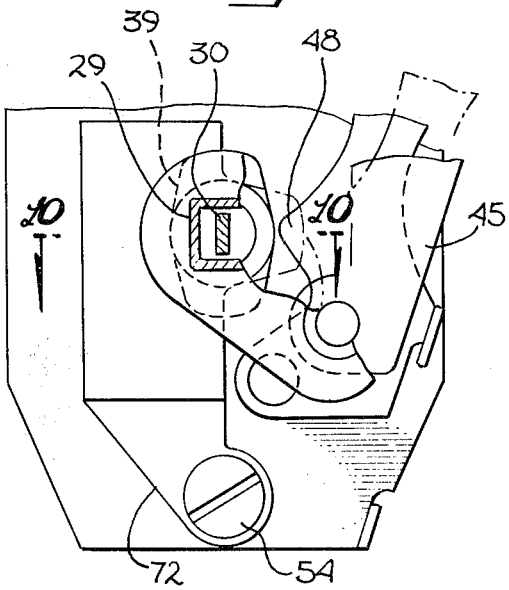
FIG. 9 is a cross-sectional view of the escutcheon taken through section lines 9—9 of FIG. 3 showing the partial view of a latch driving assembly and a latch engaging cam.
Figure 10:
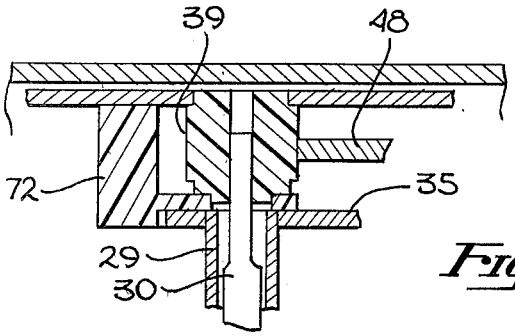
FIG. 10 is a partial cross-sectional view of the escutcheon taken through section lines 10—10 of FIG. 9 showing a solid spindle engaged in a pin engaging cam.

FIGS. 9 and 10 show the solid spindle 30 disposed inside the hollow spindle 29. FIGS. 9 and 10 also show the relative positions of the pin track protrusion 48, disposed along the pin track 45 and the solid spindle engaging cam 39. One can see that the solid spindle 30 is free to rotate inside the hollow spindle 29, and that only the solid spindle 30 is disposed in the solid spindle cam 39, while the hollow spindle 29 is engaged only by the latch engaging cam 35. When the solid spindle 30 is rotated to a second position, the lock mechanism is now in the "locked position". The solid spindle 30 is rotated by rotation of the control button member 26 shown in FIGS. 4 and 8 from the first position to the second position. Referring again to FIG. 9, when the control button member 26 is rotated to the second position, the solid spindle 30 causes the solid spindle cam 39 to push against the protrusion 48 disposed on the pin track 45. The cam 39 is held in position by cam holder 72 and screw means 54. Rotation of the cam 39 against the protrusion 48 by rotation of the control button member 26 forces the entire pin track 45 to an outward position and disengages the thumb piece actuator 21 and the grooved pin movement cam 49.

Figure 12:
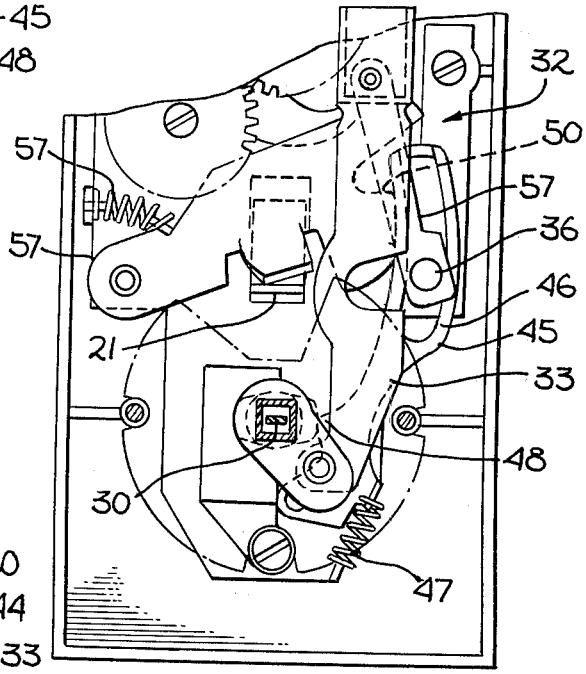
FIG. 12 is a partial cross section of the escutcheon and lock mechanism of FIG. 3 showing the thumb actuator depressed without engaging the latch driving assembly.

Referring to FIG. 11, the effect of rotation of the control button member 26 to the second position and the relationship of the pin track 45 to the other elements of the assembly can be clearly seen. Notice that the solid spindle 30 is in a horizontal position when the control button member 26 is in the second position. The pin track 45 is shown as coupled to the latch driving assembly 32 via pin 36. The rotation of the control button member 26 causes the solid spindle 30, disposed in cam 39, to rotate and thus, cam 39 is caused to move into a second position. Pin 36 is also engaged by the track slot 46 because the pin 36 is disposed through the pin arm 37. Thus, the pin 36 engages the pin movement groove 50 on the pin movement arm 49 (as best shown in FIG. 7) when the control button member 26 is in the first position, and the same pin 36 is also disposed in and engaged by the track slot 46 as shown in FIGS. 11 and 12. As the pin arm 37 is operatively coupled to the control button member 26, the pin arm 37 is caused to swing to the outward position because of swivel rivet 38 when said control button member is moved into the second position. By causing the pin 36 to swing outwardly from the assembly, it can no longer be engaged by the pin movement groove 50. When the pin track 45 is in the second and outward position (by placing the control button member 26 in the second position), tension is placed on the pin track spring 47. This spring 47 causes the pin track 45 to return to the first position shown in FIGS. 9 and 10 when the cam 39 is rotated to its first upright position.

In FIG. 12 the thumb piece actuator 21 has been depressed causing the grooved pin movement arm 49 to move in an upward position. Note, however, that because the pin 36 is disposed in an outward position from groove 50, depressing the thumb piece actuator 21 does not activate the latch driving assembly 32 (as the arm 49 can no longer engage the pin 36) and thus, does not cause the latch bolt 22 to retract. This is another novel and important aspect of the present invention. The thumb piece actuator 21 can be fully depressed without causing the opening of the door. As pointed out, prior art locks did not allow the thumb piece actuator to be fully depressed without activating the lock mechanism causing the door to open. Releasing the thumb piece actuator 21 will cause the grooved pin movement arm 49 to return to its original position because of the tension placed on spring 57.

Figure 13:
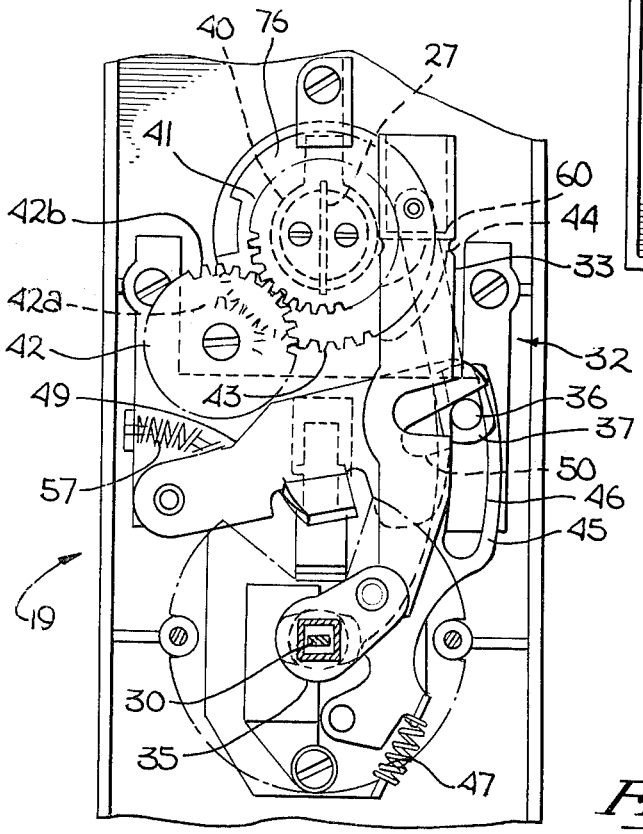
FIG. 13 is a further cross-sectional view of the escutcheon and lock mechanism of FIG. 3 showing the mechanism in the locked position with the latch driving assembly activated by a lock cylinder assembly and the associated key.

As shown in FIG. 13, even though the track slot 46 has caused the pin 36 to be positioned into the outward position (and no longer engaged by the pin movement groove 50), the latch bolt 22, shown in FIG. 8, can still be moved into the retracted position. When the lock cylinder assembly 40 and the gears 41, 42*a*, 42*b*, and 43 are again rotated as previously described, the gear arm 44 engages the latch driving means 32 at the arm ledge 60 and causes the latch driving means 32 to be disposed in the upward position. As previously discussed, the upward movement causes the latch engaging cam 35 to rotate, which in turn activates the latch bolt 22 and causes the bolt 22 to be moved into the retracted position (see FIG. 8). Thus, another important aspect of the present invention is demonstrated, namely, that when the control button member 26 is in the second position, the latch bolt 22 can be activated by the lock cylinder assembly 40 and a gear driven system but cannot be activated by the thumb piece actuator 21. Note in FIG. 13 that as the notched arm 33 is moved in the upward position, the pin arm 37 is also moved in the upward position. The pin 36 may rise up to the pin movement arm 49 and engage it causing the pin movement arm 49 to be positioned in the upward position. However, the action of the arm 49 is passive with respect to the lock mechanism and has no effect on the operation of the lock mechanism. The arm 49, if engaged by the upward travel of the pin 36, merely goes along for the ride.

The door lock mechanism of the present invention may be installed in a door with conventional equipment and without the need for an additional hole to accommodate the lock cylinder assembly 40. The specific equipment used for installation is well known in the art and is not part of the present invention. Once installed, the inside door knob 25 may always be rotated and used to open the door irrespective of the position of the control button member 26.

The detailed description of the preferred embodiment of the present invention has been presented; it is to be understood that modifications and variations thereof may be made by one skilled in the art for adaptations to the present invention to door lock mechanisms of other designs without departing from the scope and spirit of the present application.

I claim:

1. A door lock comprising:

a. a lock mechanism, said lock mechanism having disposed therein, a reciprocating latch bolt, a latch driving means for engaging said latch bolt, and a rotatable lock cylinder assembly, said latch driving means effecting movement of said latch bolt from extended to retracted positions, said lock cylinder assembly having at least a first, second and third gear means for actuating said latch driving means, said first gear means is coupled to said lock cylinder assembly and engages said second gear means, said second gear means engages said third gear means, and said third gear means is arranged and configured such that rotation of said lock cylinder assembly causes said third gear means to engage said latch driving means thereby effecting movement of said latch bolt;

b. an actuating member coupled to said latch driving means to selectively cause said latch driving means to effect movement of said latch bolt; and c. a selective control member, said selective control member and said latch driving means cooperatively coupled in said lock mechanism such that when said selective control member is in in a first position, said actuating member, when activated, engages said latch driving means and causes said latch bolt to move into said retracted position, and when said selective control member is in a second position, said latch driving means is disengaged from said actuating member, whereby said actuating member may be activated without causing said latch bolt to move into said retracted position.

2. The door lock as defined in claim 1, wherein said lock cylinder assembly is rotated by an associated key.

3. The door lock as defined in claim 1, wherein said lock cylinder assembly effects movement of said latch bolt when said selective control member is in said first or said second position.

4. The door lock as defined in claim 1, wherein said third gear means comprises an arm member which engages said latch driving means.

5. The door lock as defined in claim 4, wherein said arm is positioned radially and along the periphery of said third gear means.

6. The door lock as defined in claim 4, wherein said third gear means has gear teeth covering approximately one fourth of its circumference.

7. The door lock as defined in claim 1, wherein said gears are made from a material selected from the group consisting of metal and plastic.

8. The door lock as defined in claim 1, wherein said gears are made as a casting or molding.

9. The door lock as defined in claim 1, wherein said third gear means is axially disposed in said lock mechanism around said lock cylinder assembly.

10. The door lock as defined in claim 1, wherein said second gear means comprises a first and second transmitter gears, said first transmitter gear engaged by said first gear means and said second transmitter gear engaged by said third gear means such that rotation of said lock cylinder assembly causes said third gear means to rotate.

11. The door lock as defined in claim 10, wherein said first and second transmitter gears have gear ratios which cause said third gear means to rotate approximately 60° when said first gear means rotates approximately 180°.

12. The door lock as defined in claim 1, wherein said latch driving means comprises an arm having an arm ledge, said arm and arm ledge being engaged by said third gear means such that when said lock cylinder assembly is rotated said third gear means engages said arm ledge and arm whereby said latch bolt is caused to move into said retracted position.

13. The door lock as defined in claim 12, wherein said latch driving means comprises, in addition thereto, a latch engaging cam, said latch engaging cam being operatively coupled to said latch bolt and to said arm and arm ledge such that when said third gear means engages said arm ledge, said latch engaging cam is caused to rotate whereby said latch bolt is caused to move into said retracted position.

14. The door lock as defined in claim 1, wherein said latch driving means for engaging said latch bolt comprises:

a pin arm and a pin disposed thereon, said pin arm and pin being operatively coupled to said selective control member such that when said selective control member is in said first position, depression of said actuating member causes said actuating member to engage said pin and pin arm whereby said latch bolt is caused to move into said retracted position; and when said selective control member is in said second position, said pin arm and pin cannot be engaged by said actuating member.

15. The door lock as defined in claim 1, wherein said latch driving means for engaging said latch bolt comprises:

an arm with a latch engaging cam mounted thereto, said latch engaging cam being operatively coupled to said selective control member and to said latch bolt by means of a spindle member such that when said selective control member is in said first position, depression of said actuating member causes said actuating member to engage said arm, said arm causes said latch engaging cam to rotate and thereby revolve said spindle member, whereby said latch bolt is caused to move into said retracted position; and when said selective control member is in said second position, said arm and latch engaging cam cannot be engaged by said actuating member.

16. The door lock as defined in claim 12, wherein solid spindle member is disposed in said selective control member, said solid spindle member being coupled to and effecting movement of said spindle cam.

17. The door lock as defined in claim 1, wherein said selective control member is coupled to a said spindle cam, engaging said latch driving means and effects movement of said latch driving means such that when said selective control member is in said first position, said spindle cam causes said latch driving means to be engaged by said actuating member; and when said selective control member is in said second position, said spindle cam causes said latch driving means to be disengaged from actuating member.

18. The door lock as defined in claim 17, wherein said selective control member has a solid spindle disposed therein, said solid spindle effecting movement of said spindle cam.

19. The door lock as defined in claim 1, wherein in addition thereto, a rotating hollow spindle member is disposed in said mechanism, said hollow spindle operatively coupling said latch driving means and said latch bolt.

20. A door lock comprising:

a. a lock mechanism, said lock mechanism having a reciprocating latch bolt disposed therein;

b. a latch driving means disposed on said lock mechanism for effecting movement of said latch bolt from extended to retracted positions, said latch driving means having an arm and latch engaging cam mounted at one end of said arm;

c. a rotating hollow spindle member having longitudinal axial rotation disposed on said lock mechanism, said spindle member operatively coupling said latch driving means and said latch bolt;

d. an actuating member coupled to said latch driving means to selectively cause said latch driving means to effect movement of said latch bolt; and e. a selective control member, said selective control member and said latch driving means being cooperatively coupled in said lock mechanism such that when said selective control member is in a first position, said actuating member, when activated, engages said arm which causes said latch engaging cam to rotate thereby rotating said hollow spindle member which causes said latch bolt to move into said retracted position, and when said selective control member is in a second position, said arm and latch engaging cam are disengaged from said actuating member, whereby said actuating member may be activated without causing said latch bolt to move into said retracted position.

21. The door lock as defined in claim 20 wherein said latch driving means for engaging said latch bolt comprises:

a pin arm mounted at the other end of said arm with a pin disposed therein, said pin arm and pin being operatively coupled to said selective control member such that when said selective control member is in said first position, depression of said actuating member causes said actuating member to engage said pin and pin arm, and said pin arm causes said arm to effect motion of said latch engaging cam and said hollow spindle member whereby said latch bolt is caused to move into said retracted position; and when said selective control member is in said second position, said pin arm and pin cannot be engaged by said actuating member.

22. The door lock as defined in claim 20, wherein a solid spindle member is disposed in said hollow spindle, said hollow spindle being coupled to a spindle cam, said spindle cam disposed in said door lock so as to engage said latch driving means and to effect movement of said latch driving means such that when said selective control member is in said first position, said spindle cam causes said latch driving means to be engaged by said actuating member; and when said selective control member is in said second position, said spindle cam causes said latch driving means to be disengaged from actuating member.

23. The door lock as defined in claim 20, wherein said actuating member comprises a thumb piece actuator and a pin movement arm, said pin movement arm is coupled to said latch driving means such that when said selective control member is in said first position, said thumb piece actuator, when activated, engages said pin movement arm, causing said pin movement arm to engage said latch driving means, whereby said latch bolt is caused to move into said retracted position; and when said selective control member is in said second position, said thumb piece actuator and said pin movement arm cannot engage said latch driving means.

24. The door lock as defined in claim 20, wherein said selective control member is rotatable from said first position to said second position.

25. The door lock as defined in claim 20, wherein said selective control member is coupled to a spindle cam, said spindle cam engages said latch driving means and effects movement of said latch driving means such that when said selective control member is in said first position, said spindle cam causes said latch driving means to be engaged by said actuating member; and when said selective control member is in said second position, said spindle cam causes said latch driving means to be disengaged from said actuating member.

26. The door lock as defined in claim 21, wherein said actuating member comprises a thumb piece actuator and pin movement arm; said thumb piece actuator, when activated, engages said pin movement arm, said pin movement arm being disposed in said door lock mechanism between said thumb piece actuator and said pin, such that depression of said thumb piece actuator causes said pin movement arm to engage said pin when said selective control member is in said first position; and when said selective control member is in said second position, said thumb piece actuator and said pin movement arm cannot engage said pin.

* * * * *